United States Patent [19]

Lillo

[11] 4,246,041

[45] Jan. 20, 1981

[54] METHOD AND APPARATUS FOR CLEANING A ROTARY AGITATOR IN A REACTOR

[75] Inventor: Jean-Pierre Lillo, Lyons, France

[73] Assignee: Rhone-Poulenc Industries, Paris, France

[21] Appl. No.: 848,246

[22] Filed: Nov. 3, 1977

Related U.S. Application Data

[63] Continuation of Ser. No. 689,975, May 26, 1976, abandoned.

[30] Foreign Application Priority Data

May 28, 1975 [FR] France ..... 75 16662

[51] Int. Cl.[3] ..... B08B 3/02; B08B 9/08

[52] U.S. Cl. ..... 134/23; 134/24; 134/167 R

[58] Field of Search ..... 134/23, 24, 32, 33, 134/167 R, 168 R, 181; 239/239, 242, 227, 255; 366/138

[56] References Cited

U.S. PATENT DOCUMENTS

| | | | |
|---|---|---|---|
| 2,302,299 | 11/1942 | Court | 134/167 R |
| 2,691,549 | 10/1954 | Hayward | 239/242 X |
| 2,858,836 | 11/1958 | Geh et al. | 134/181 X |
| 3,379,379 | 4/1968 | Orem | 239/242 X |
| 3,495,808 | 2/1970 | Klein et al. | 366/138 |
| 3,652,014 | 3/1972 | Neville | 239/287 |
| 3,729,177 | 4/1973 | Keyes et al. | 366/138 |
| 3,833,417 | 9/1974 | Griparis | 134/23 X |
| 3,981,315 | 9/1976 | Olthoff | 134/167 R |

*Primary Examiner*—Marc L. Caroff

*Attorney, Agent, or Firm*—McDougall, Hersh & Scott

[57] ABSTRACT

An agitator mounted in a reactor is cleaned while being rotated by introducing an unconfined jet stream of pressurized liquid from a nozzle through an opening in the reactor wall into contact with the agitator and oscillating the nozzle so that the liquid jet oscillates in a plane passing substantially through the axis of the reactor.

10 Claims, 3 Drawing Figures

METHOD AND APPARATUS FOR CLEANING A ROTARY AGITATOR IN A REACTOR

This is a continuation of application Ser. No. 689,975, filed May 26, 1976, now abandoned.

The invention relates to a method and apparatus for cleaning a rotary agitator directed along the axis of a reactor and passing close to its wall, by means of a jet of pressurized liquid.

Normal methods of cleaning reactors with a jet of pressurized liquid comprise inserting an injection nozzle into the reactor. In the case of a reactor equipped with a rotary agitator directed along its axis and passing close to its walls, such method does not enable the agitator to be cleaned while in movement.

It is an object of this invention to provide a method and apparatus which overcomes this disadvantage and enables the reactor and agitator to be cleaned while the agitator is in operation.

These and other objects and advantages of this invention will hereinafter appear and for purposes of illustration, but not of limitation, an embodiment of the invention is shown in the accompanying drawings, in which FIG. 1 is a sectional elevational view of the cleaning arrangement of this invention shown in a plane perpendicular to the axis of the reactor;

Figure 1:
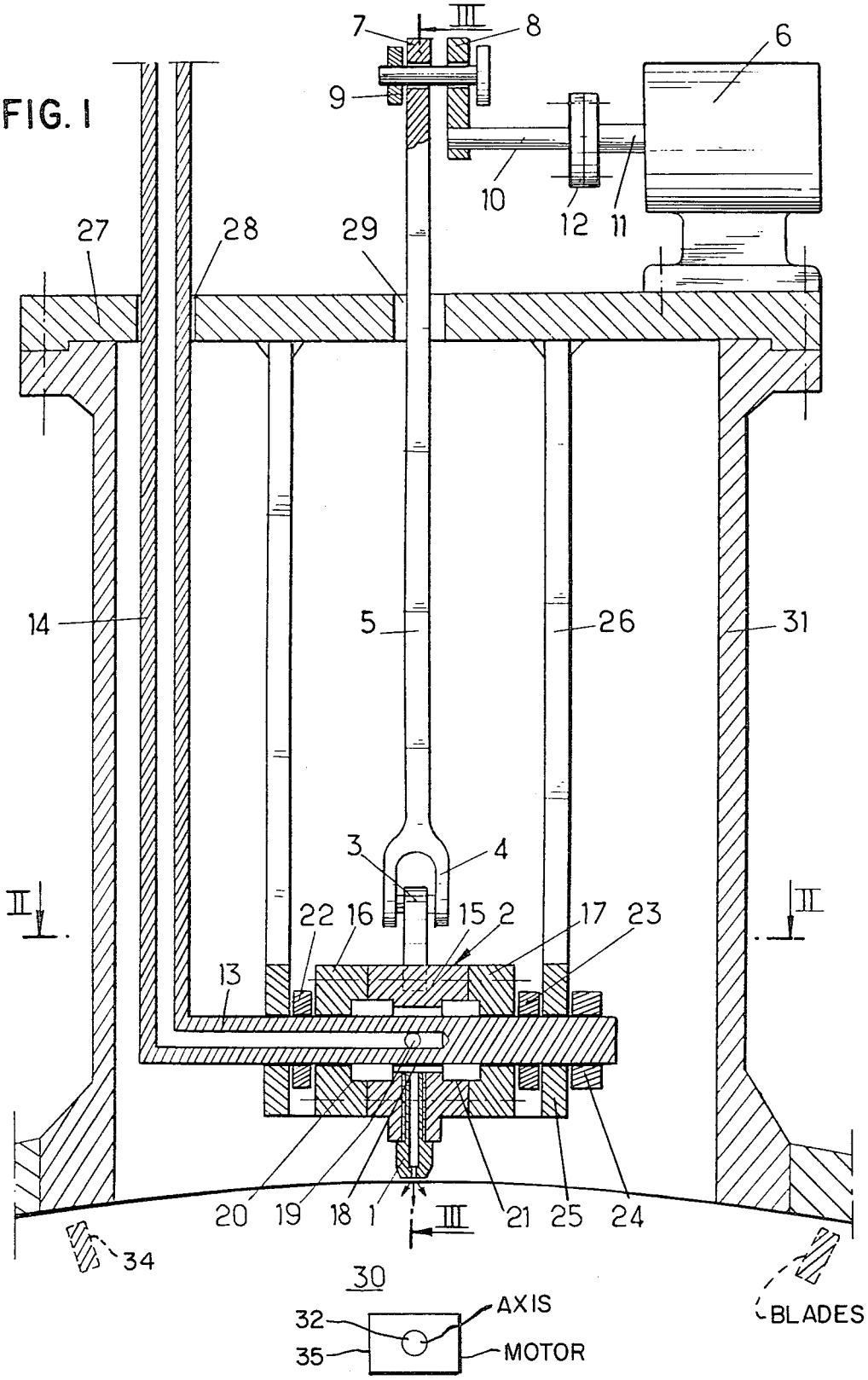
Figure 2:
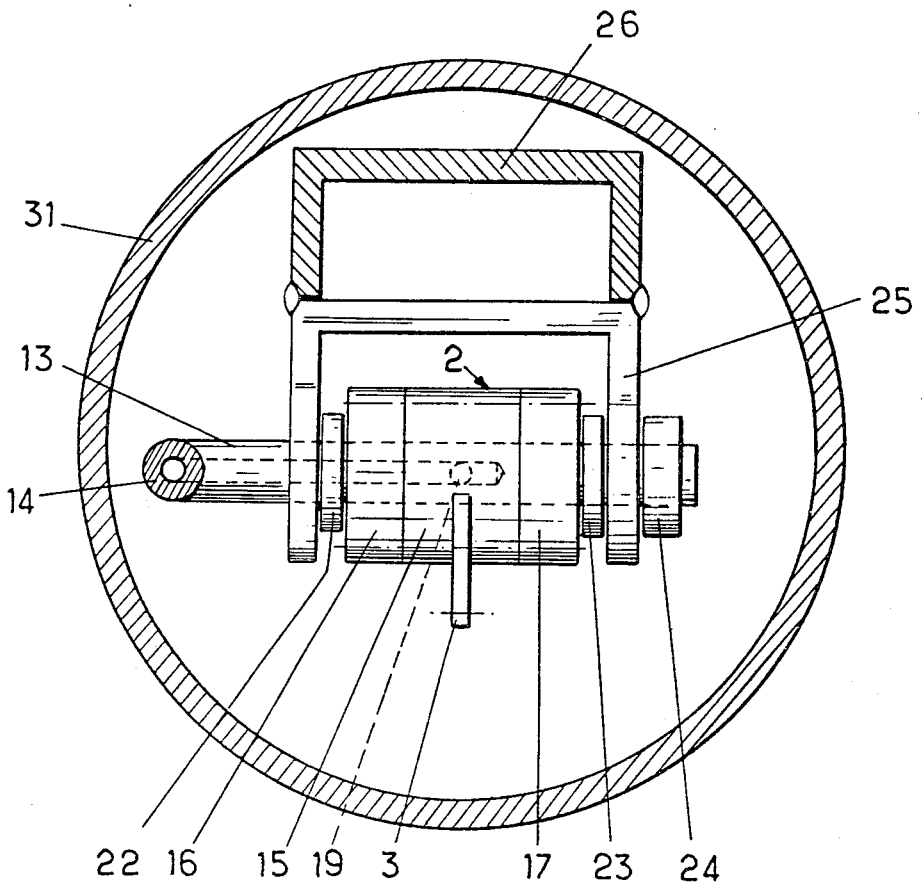
FIG. 2 is a sectional view taken along the line II—II of FIG. 1.
Figure 3:
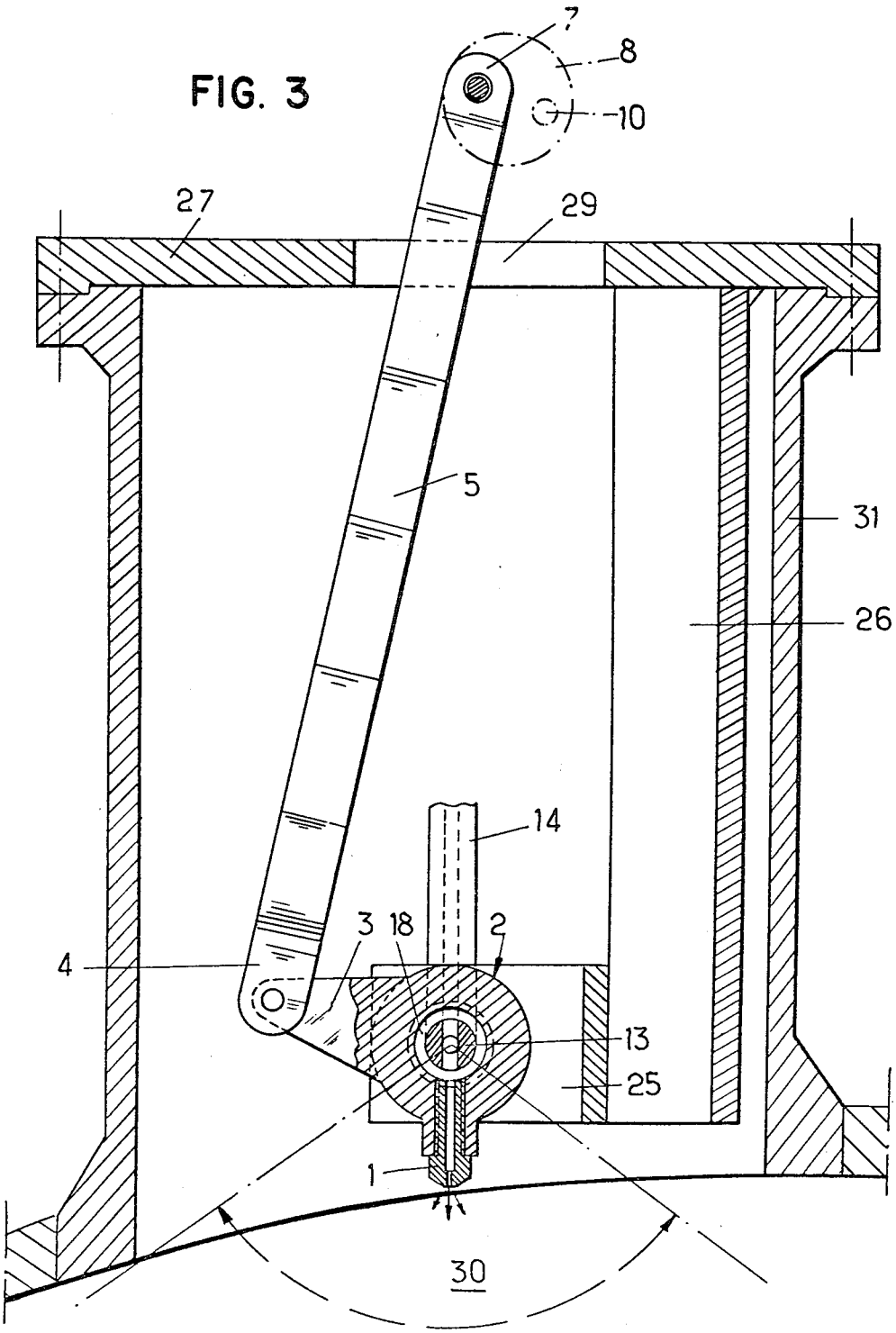
FIG. 3 is a sectional view taken along the line III—III of FIG. 1.

In the course of its rotation, the agitator sweeps over one or more coaxial surfaces of revolution, depending upon its shape.

In the method of this invention, the jet of pressurized liquid directed into the reactor comes from adjacent and beyond the external face of the surface of revolution over which the agitator sweeps during its rotation. The cross-section thereof, perpendicular to the axis of the reactor, is the maximum-diameter cross-section at every point along said axis, and the jet oscillates in a plane passing substantially through the axis of the reactor.

The cleaning arrangement according to the invention is of the type comprising means for producing a jet of pressurized liquid, including an injection nozzle. It comprises means for oscillating the injection nozzle in a plane, preferably through an angle of 30 to 170 degrees for satisfactory operation.

In another special embodiment of the cleaning arrangement, in accordance with the practice of this invention, the arrangement is mounted in a sealed relation within a neck portion extending from the reactor, such as neck 31. This makes it unnecessary for the arrangement to be withdrawn before the reactor is used.

Referring now to the drawings, the cleaning arrangement comprises an injection nozzle 1 supported by a nozzle carrier 2.

The nozzle carrier 2 is rigidly connected to a crank 3 which is pivotally connected by a joint at one end 4 of an elongate rod 5. A motor 6 drives the other end 7 of rod 5 in a rotary movement in a plane perpendicular to that of FIG. 1, as by means of a cam 8. A ring 9 holds cam 8 in position. A shaft 10 of cam 8 is connected to a drive shaft 11 by a coupling sleeve 12.

Nozzle carrier 2 oscillates about a hollow shaft 13 connected to a pipe 14 through which the injection nozzle 1 is supplied with liquid from a suitable supply source.

Nozzle carrier 2 has three components, namely, a central element 15 rigidly connected to injection nozzle 1 and sandwiched between two lateral elements 16 and 17 rigidly connected to the central element 15. An annular space 18, communicating with the inside of shaft 13, through an aperture 19, and also communicating with injection nozzle 1, is provided between shaft 13 and central element 15. An annular space is made fluid-tight by seals 20 and 21. Rings 22 and 23 and ring 24, respectively hold the nozzle carrier 2 and shaft 13 in position.

Shaft 13 is rigidly connected to a stirrup-piece 25 which in turn is rigidly connected to a U-shaped beam 26 which is rigidly joined to the underside of a supporting plate 27. The supporting plate 27 has an aperture 28 for passage of pipe 14 therethrough and an aperture 29 for the passage of rod 5 therethrough while the motor 6 is fixed to the top side of the plate 27.

The cleaning arrangement is mounted on reactor 30 by fixing supporting plate 27 onto neck 31 extending from the reactor 30. The cleaning arrangement and neck 31 are designed so that the oscillating plane of the injection nozzle 1 passes through the axis 32 of the reactor 30 so that the outlet orifice of nozzle 1 is near but beyond the external face of the surface of revolution over which the agitator 34 sweeps during its rotation; the cross-section thereof, perpendicular to the axis of the reactor, is the maximum-diameter cross-section at every point along the axis. The agitator is rotated by conventional means 35. Reactor 30 may have more than one neck portion, each being designed to receive a cleaning arrangement according to the invention. When the cleaning process is over, the arrangements may be withdrawn and each neck sealed by an appropriate means, such as a cover.

It will be understood that changes may be made in the details of construction, arrangement and operation, without departing from the spirit of the invention, especially as defined in the following claims.

I claim:

1. In a method of cleaning a rotary agitator extending along the axis of a reactor and having a surface of revolution parallel with the axis of the reactor passing in close proximity to the walls of the reactor, comprising introducing an unconfined jet stream of pressurized liquid from a nozzle through an opening in the reactor wall from near the outside of the surface of revolution over which the agitator sweeps during its rotation into contact with the agitator, the cross-section of the surface of revolution perpendicular to the axis of the reactor being a maximum at every point along the axis, and oscillating the nozzle so that the jet of pressurized liquid introduced through the opening in the reactor wall oscillates in a plane passing substantially through the axis of the reactor while rotating the agitator.

2. A method as claimed in claim 1 in which the angle of oscillation of the jet of pressurized liquid is from 30 to 170 degrees.

3. In an apparatus having an agitator extending along the axis of a reactor, mounted for rotational movement about the axis of the reactor and having a surface of revolution parallel to the axis of the reactor passing in close proximity to the walls of the reactor, the improvement comprising a reactor housing having at least one opening in one wall of the reactor, an injection nozzle mounted immediately outwardly of the interior surface of said wall for introducing an unconfined jet stream of pressurized liquid through said opening into contact with the agitator, means for oscillating the nozzle in a plane passing substantially through the axis of the reactor and means for rotating the agitator within the reactor.

4. A cleaning apparatus as claimed in claim 3 in which the injection nozzle is mounted for oscillation through an angle of from 30 to 170 degrees.

5. A cleaning apparatus as claimed in claim 3 which includes a nozzle carrier for support of the injection nozzle and means for mounting the carrier onto the reactor housing.

6. A cleaning apparatus as claimed in claim 5 in which the means for oscillating the injection nozzle comprises a stationary shaft, means mounting the nozzle carrier on the shaft for rotational movement about the shaft as the axis, a crank rigidly connected to the nozzle carrier, a motor driven cam, and a rod pivotally connected at one end to the crank and at the other end to the cam.

7. A cleaning apparatus as claimed in claim 6 which includes a source of pressurized liquid, and a hollow shaft about which the nozzle carrier oscillates and which is connected to the source of pressurized liquid for supplying liquid to the nozzle.

8. A cleaning apparatus as claimed in claim 7 in which the nozzle carrier has three components, namely, a central element rigidly connected to the injection nozzle and two lateral elements rigidly connected to the central element, and an annular space between the shaft and the central element which communicates with the inside of the shaft and with the injection nozzle.

9. A cleaning apparatus as claimed in claim 7 which includes a stirrup-piece rigid with the shaft, a U-shaped beam supporting the stirrup-piece and a plate to which the beam is rigidly connected, said plate having an opening for the passage of a pipe connecting the nozzle to the liquid supply source and for passage of the rod therethrough.

10. A cleaning apparatus as claimed in claim 3 which includes a neck tube extending from the reactor and about the opening, and means for mounting the nozzle in the neck tube.

* * * * *